US005659347A

United States Patent [19]

Taylor

[11] Patent Number: 5,659,347

[45] Date of Patent: Aug. 19, 1997

[54] INK SUPPLY APPARATUS

[75] Inventor: Thomas N. Taylor, Rochester, N.Y.

[73] Assignee: Xerox Corporation, Stamford, Conn.

[21] Appl. No.: 338,708

[22] Filed: Nov. 14, 1994

[51] Int. Cl.[6] ..... B41J 2/17

[52] U.S. Cl. ..... 347/85; 137/625.41; 347/25; 347/28

[58] Field of Search ..... 347/28, 84, 85, 347/43, 25; 137/240, 625.41

[56] References Cited

U.S. PATENT DOCUMENTS

| | | | |
|---|---|---|---|
| 3,586,049 | 6/1971 | Adamson | 137/625.41 |
| 4,043,359 | 8/1977 | Christo | 137/625.41 |
| 4,908,638 | 3/1990 | Albasta et al. | 346/140 |
| 4,987,429 | 1/1991 | Finley et al. | 347/28 |
| 5,126,752 | 6/1992 | Weinberg | 346/1.1 |

*Primary Examiner*—John E. Barlow, Jr.
*Attorney, Agent, or Firm*—Daniel J. Krieger

[57] ABSTRACT

A valve for selecting an ink from a plurality of different types of inks having no dead spaces to prevent ink of one type from contaminating ink of a second type. The valve includes a selecting member with a channel and a housing having first, second and third passages. The housing defines with the valve a cleaning chamber in communicating relation with the channel and the first, second, and third passages. The cleaning chamber receives a solvent between changing from one ink to another ink which cleans the selecting member and chamber thereby preventing mixing of inks of different types.

13 Claims, 4 Drawing Sheets

INK SUPPLY APPARATUS

FIELD OF THE INVENTION

This invention relates generally to changing ink in an ink jet printer and more particularly to an ink supply apparatus to prevent ink of one type from contaminating ink of a second type when changing from one ink to another ink.

BACKGROUND OF THE INVENTION

In existing thermal ink jet printing, the printhead typically comprises one or more ink ejectors, such as disclosed in U.S. Pat. No. 4,463,359. Each ejector includes a channel communicating with an ink supply chamber, or manifold, at one end and has an opening at the opposite end, referred to as a nozzle. A thermal energy generator, usually a resistor, is located in each of the channels, a predetermined distance from the nozzles. The resistors are individually addressed with a current pulse to momentarily vaporize the ink and form a bubble which expels an ink droplet. As the bubble grows, the ink rapidly bulges from the nozzle and is momentarily contained by the surface tension of the ink as a meniscus. As the bubble begins to collapse, the ink still in the channel between the nozzle and bubble starts to move towards the collapsing bubble, causing a volumetric contraction of the ink at the nozzle and resulting in the separation of the bulging ink as a droplet. The acceleration of the ink out of the nozzle while the bubble is growing provides the momentum and velocity of the droplet in a substantially straight line direction towards a print sheet, such as a piece of paper. Because the droplet of ink is emitted only when the resistor is actuated, this type of thermal ink-jet printing is known as "drop-on-demand" printing. Other types of ink-jet printing, such as continuous-stream or acoustic, are also known.

In a single-color ink jet printing apparatus, the printhead typically comprises a linear array of ejectors, and the printhead is moved relative to the surface of the print sheet, either by moving the print sheet relative to a stationary printhead, or vice-versa, or both. In some types of apparatus, a relatively small printhead moves across a print sheet numerous times in swaths, much like a typewriter; alternatively, a printhead which consists of an array of ejectors and extends the full width of the print sheet may pass one time down the print sheet to give full-page images, in what is known as a "full-width array" (FWA) printer. In a second type of FWA printer, the printhead remains stationary and the print sheet passes the printhead. When the printhead and the print sheet are moved relative to each other, imagewise digital data is used to selectively activate the thermal energy generators in the printhead over time so that the desired image will be created on the print sheet.

With ink-jet printing, it is also possible to create multicolor images on a print sheet. This type of printing may be used for full-color images, such as to reproduce a color photograph, or can be employed for "highlight" color, in which colored additions are made to a main portion of the image or text, which is typically black. In addition to being able to print multicolor images or images having highlight color, it is also desirable to print successive batches of documents with different color inks or with different types of inks, such as fast drying or slow drying inks with one printing machine.

In each of these instances, it may be necessary to change the ink currently being printed to a different type of ink without having to change the printhead. In such cases, fast and accurate changing of the ink without mixing of inks is essential to printing accurate reproductions of color images.

In U.S. Pat. No. 4,908,638 to Albosta et al., an n-way selecting mechanism for selecting inks from a number of ink supply containers for delivery to the marking head of an ink jet printer is described. The selecting mechanism includes a rotary diverting valve which is positioned to allow the marking head to receive ink from one color supply container or another color supply container.

U.S. Pat. No. 5,126,752 to Weinberg describes an ink jet printer head flushing system. The flushing system includes a number of valves and lines in which solvent is delivered to a print head over an ink feed line by using a suction device and an ink pump.

SUMMARY OF THE INVENTION

In accordance with one aspect of the present invention, there is provided a valve for selecting an ink station or a cleaning station having a selecting member and a housing. The selecting member defines an aperture. The housing defines a plurality of passageways and cooperates with the selecting member so that the relative movement therebetween aligns the aperture with a passageway. The ink station is in communication with a first passageway on the housing and the cleaning station is in communication with a second passageway in the housing.

Pursuant to another aspect of the present invention, there is provided a method of supplying a first liquid ink and a second liquid ink through a common conduit to a printhead. The method of supplying includes the steps of filling the conduit with the first liquid ink, moving a valve to disconnect the conduit from a supply of the first liquid ink and to connect the conduit to a supply of cleaning material, filling the conduit with the cleaning material, moving the valve to disconnect the conduit from the supply of cleaning material and to connect the conduit to a supply of the second liquid ink, and filling the conduit with the second liquid ink.

A further aspect of the invention includes an ink supply apparatus having a selecting member defining an aperture therethrough and a housing. The housing defines a plurality of passageways, and defines with the selecting member a cleaning chamber in communicating relation with the aperture and at least one of the plurality of passageways. A first ink supply is connected to a first passageway of the plurality of passageways. A second ink supply is connected to a second passageway of the plurality of passageways. A solvent supply is connected to a third passageway of the plurality of passageways.

Other features of the present invention will become apparent as the following description proceeds and upon reference to the drawings:

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
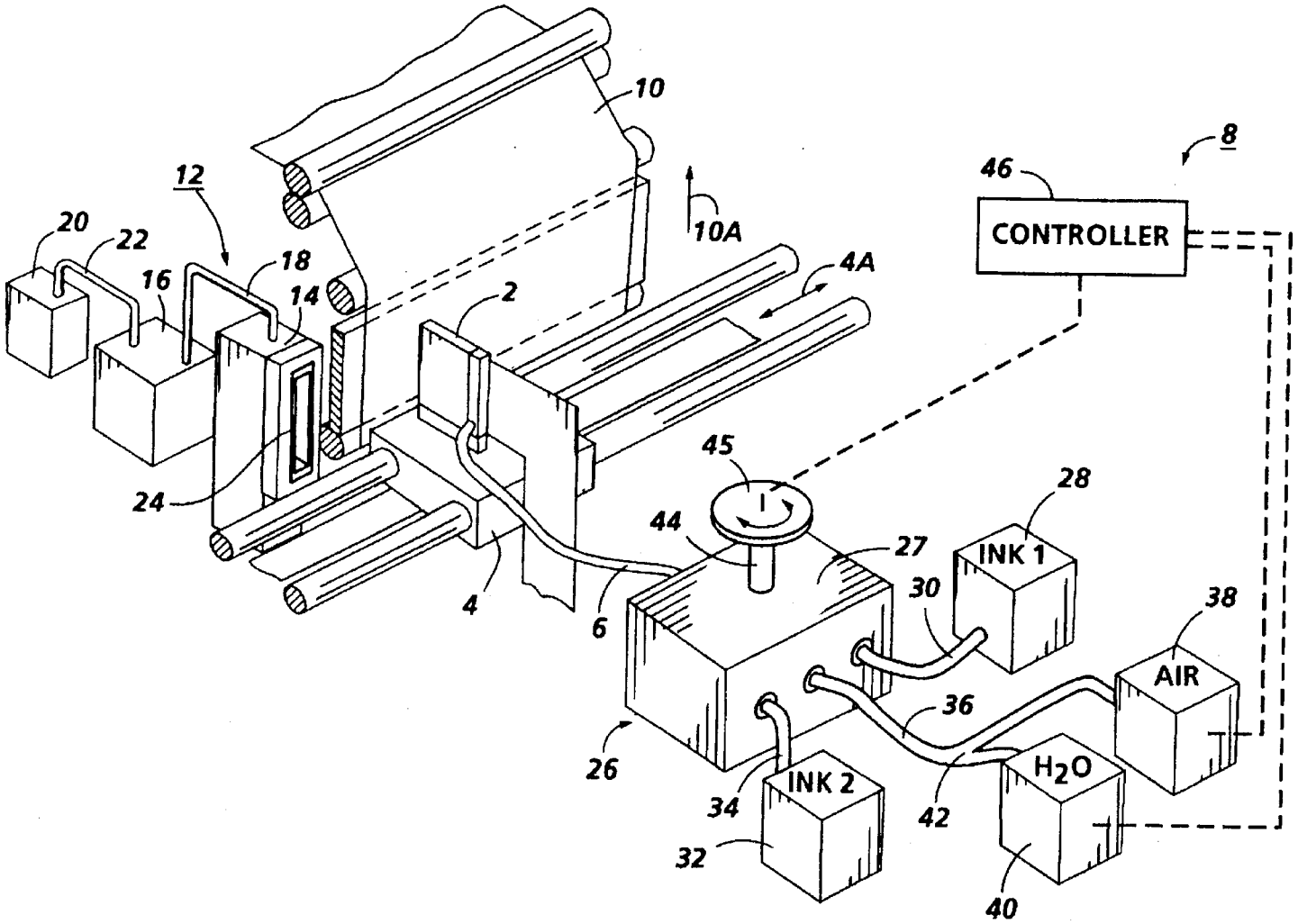
FIG. 1 is a schematic perspective view of a thermal ink jet printer.

The printer shown in FIG. 1 has a printhead 2 mounted on a carriage 4 connected to receive ink through an ink conduit 6 from an ink supply apparatus 8. The printhead 2 contains a plurality of ink channels, not shown in FIG. 1, which carry ink from the ink supply apparatus 8 to respective ink ejecting orifices or nozzles, also not shown in FIG. 1. When printing, the carriage 4 reciprocates back and forth across the page as indicated by the arrow 4A. Droplets of ink are expelled from selected ones of the printhead nozzles in the manner previously described and are directed to a recording medium 10 which can be a cut sheet of paper, a web of paper or other material which can receive ink from the printhead 2. During each pass of the carriage 4, the recording medium 10 is stationary. At the end of each pass, however, the recording medium 10 is stepped in the direction of the arrow 10A. For a more detailed explanation of the printhead and printing thereby refer to U.S. Pat. No. 4,571,599 and U.S. Pat. No. Reissue 32,572, incorporated herein by reference.

At one side of the printer outside the printing zone is a priming/maintenance station 12. At the completion of a printing operation, the printhead carriage 4 is parked in a location nearby the priming maintenance station 12. The priming maintenance station 12 includes a capping member 14 which is coupled to an ink trap 16 through a first line 18. The ink trap 16 is coupled to a suction pump 20 through a second line 22. The suction pump 20 applies a negative pressure or a vacuum to the capping member 14 through the lines 18 and 22 and also through the ink trap 16. The ink trap 16 traps any ink or other debris which is drawn by the capping member 14 during a priming or maintenance operation.

When the carriage 4 is parked in front of the priming/maintenance station 10 the capping member 14 is moved towards the printhead 2 until a seal or priming element 24 is in contact with the printhead 2. The priming element 24 which is coupled to the capping member 14 contacts the printhead 2 and fits tightly against the front face of the printhead 2 thereby surrounding the ink ejecting orifices.

Ink ejected from the printhead 2 is received from the ink supply apparatus 8 over the ink conduit 6. The ink supply apparatus 8 includes an ink selecting valve 26 for selecting from two or more inks or ink stations and a cleaning mechanism or station which cleans the valve 26 between changing from one type of ink to another type of ink.

As shown in FIG. 1, the ink change valve 26 includes a housing 27 and is coupled to a first ink supply 28 through an ink supply conduit 30 and to a second ink supply 32 coupled through an ink supply conduit 34. The first ink supply 28 and the second ink supply 32 contain inks of different colors or of different types such as slow drying and fast drying black inks. Additionally, the ink change valve 26 is coupled to a purge line 36 or cleansing line which is connected to an air supply 38 and to a solvent or cleaning material supply 40, holding a cleaning material such as water, through a T connection 42.

The ink change valve 26 allows for selective delivery of a number of different colors or types of ink over the ink conduit 6 to the printhead 2. As illustrated in FIG. 1, the ink change valve 26 is made to supply either ink from the ink supply 28 or ink from the ink supply 32. In addition, the ink change valve is also connected to the cleansing line 36 which provides effective cleansing of the ink change valve 26 when switching from one type of ink to another. To accomplish switching of inks, the ink change valve includes a control stem 44 coupled to a selecting member 45. The selecting member 45 can either be a knob for manual actuation or a gear for coupling to an automatic selecting apparatus such as a controller including a keyboard for automatic selection of inks.

A controller 46 is electrically connected to the selecting member 45 through a motor (not shown) for automatically controlling the selection of inks. The controller 46 also controls which of air or water flows through line 36 from the air supply 38 or water supply 40. Controller 46 is preferably a programmable microprocessor which controls the selection of inks and air or water either through preprogrammed operations selected by an operator or through active selection of inks, air and water by an operator through a keypad. For instance, the controller could control automatic printing of 100 sheets of paper in which one ink is selected for printing of 50 sheets and a second ink is selected for printing the remaining 50 sheets. The controller would control purging the valve of the first ink, cleaning the valve with air and water, and selecting the second ink.

Figure 2:
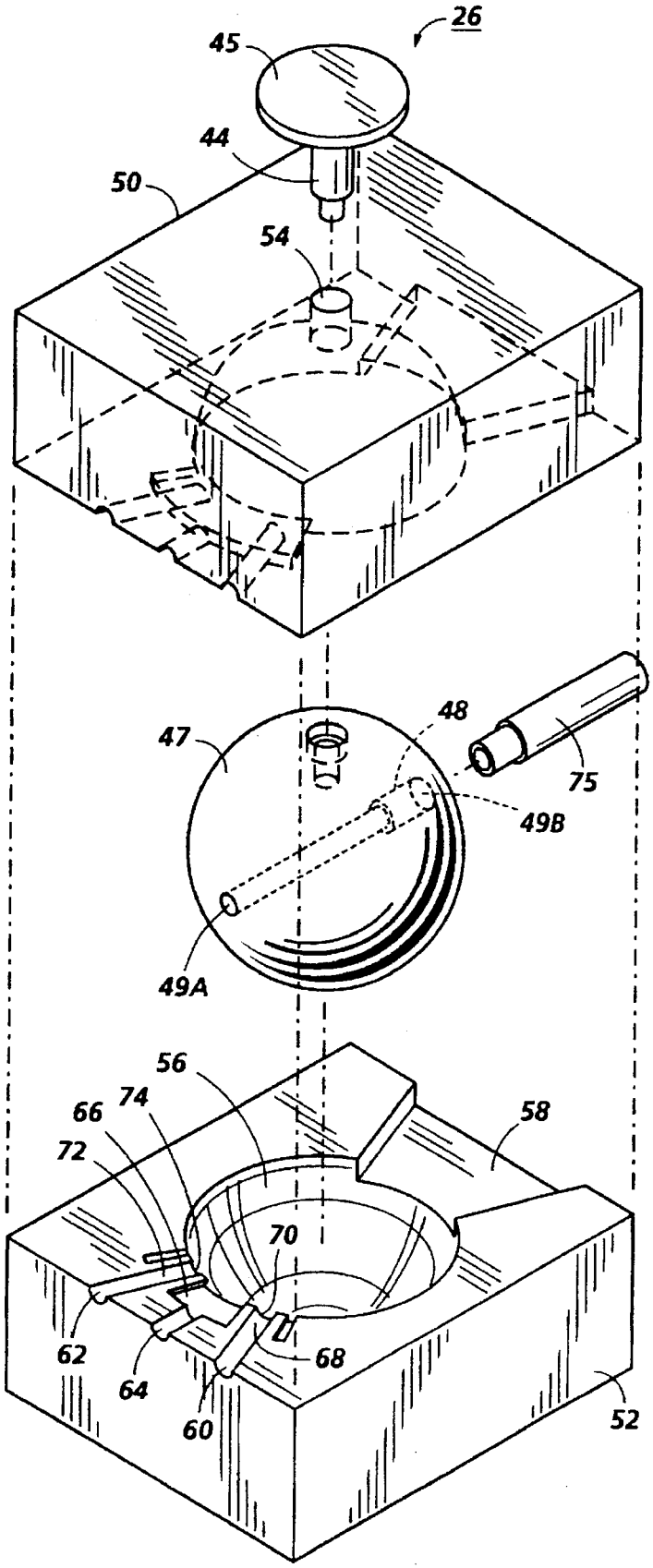
FIG. 2 is an exploded view of an ink change valve.

FIG. 2 illustrates an exploded view of the ink change valve 26 which includes a selecting member 47 having a single aperture or central channel 48 having a first end 49A and a second end 49B. The selecting member 47 is substantially a sphere with the central channel 48 running through the center of the sphere along a given plane, preferably along a horizontal plane. The selecting member 47 is supported by and sits within housing 27, which includes a top housing portion 50 and bottom housing portion 52. The top housing portion 50 and the bottom housing portion 52 are mated together with the selecting member 47 disposed therein. Each of the top housing portion 50 and the bottom housing portion 52 includes an interior surface which is concave and approximately one-half the size of the spherical outer surface of the selecting member 47. The spherical space defined by the interior concave spherical surfaces of the top housing portion 50 and the bottom housing 52 is just slightly larger than the spherical space defined by the outer surface of the selecting member 47. The slight difference in sizes enables the selecting member 47 to be moved or rotated within the interior surfaces of the housing. The selecting member 47 as well as the housing portions 50 and 52 may be made of molded plastic, preferably having a low coefficient of friction, such as Delrin.

The structural features of the bottom housing portion 52 are illustrated in FIG. 2. It is understood that these features are also inherent in the present embodiment of the top housing portion 50, shown in outline, except that the top housing portion 50 includes a cylindrical hole 54 for accepting the control stem 44 of the selecting member 47. When mated together the top housing portion 50 and the bottom housing portion 52 combined with the selecting member 47 produce a highly accurate valve arrangement having no dead spaces which could hold ink. Consequently, any mixing of inks when changing from one type of ink to another is prevented. It is also understood that the housing consisting of the top housing portion 50 and the bottom housing portion 52 need not be constructed in top and bottom halves but could also have other constructions, such as having a left-side portion and a right-side portion.

The bottom portion 52 includes a concave spherical surface 56. The concave spherical surface 56 supports the bottom half of the selecting member 47. When the selecting member 47 is placed within the concave spherical surface 56, the central channel 48 is aligned along the horizontal plane with an output opening or rectangular outlet 58. When the ink change valve 26 is in operation, the ink conduit 6 is attached to the central channel 48. Through adjustment of the selecting member 47 by moving or rotating the control stem 44, inks from the ink supplies 28 or 32 are selected and flow out through the conduit 6.

The housing 27 includes a first passageway 60 and a second passageway 62. The first passageway 60 carries ink received over the line 30 from the ink supply 28. Likewise, the second passageway 62 carries ink received over the line 34 from the ink supply 32. A third passageway 64 is connected to the purge line 36.

The housing 27 also includes a cleaning chamber or recess 66 defined between the outer surface of the selecting member 47 and the interior surfaces of the cleaning chamber 66. The chamber 66 extends from one side of the first passageway 60 to the opposite side of the second passageway 62. The chamber 66 is directly coupled to the third passageway 64 so that any fluid, solvent or gas passing through the third passageway 64 flows into the chamber 66. The central channel 48 is also in communicating relation with the chamber 66 so that any fluid located in the chamber 66 flows into the central channel 48 when the central channel 48 is not in alignment with the first passageway 60 or the second passageway 62.

The first passageway 60 and the second passageway 62 include nozzles which contact the outer surface of the selecting member 46 for purposes of directing ink from an ink supply to the printhead 2. A first nozzle 68 is connected to the first passageway 60. The nozzle 68 may be a threaded member for threadingly engaging the passageway 60 within the chamber 66 or the nozzle 68 may be formed as part of the housing 27 by forming one half of the nozzle on each of the top housing portion 50 and the bottom housing portion 52. The first nozzle 68 terminates at an outer cylindrical portion 70 which fits tightly against the outer surface of the selecting member 47. Likewise, the second passageway 62 includes a second nozzle 72 which also terminates at an outer cylindrical portion 74 which also fits tightly against the outer cylindrical surface of the selecting member 47. Due to the tight fit of the nozzles to the surface of the selecting member, any air, gas or solvent located in the chamber 66 should not enter the central channel 48 when the central channel 48 is aligned with either the first passageway 60 or the second passageway 62. The tight fit also prevents any ink flowing through first passageway 60 or the second passageway 62 from escaping into the chamber 66. In addition, the walls of the first nozzle 68 and the second nozzle 72 have a thickness which prevents leakage of ink into the chamber 66 if either the first or second nozzles are misaligned with the central channel 48.

Figure 3:
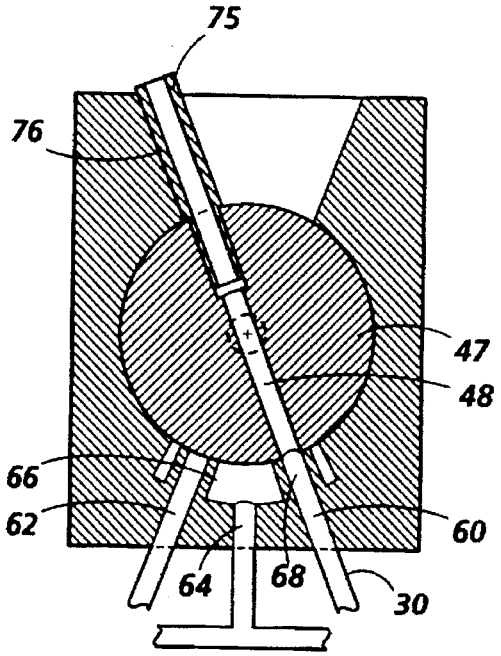
FIGS. 3 through 6 are schematic diagrams illustrating the positions of the ink change valve and steps for operation thereof.

When printing an ink from the first ink supply 28, the control stem 44 is rotated to position the central channel 48 in alignment with either the first passageway 60 or second passageway 62. If the first passageway 60 is selected, ink flows through the first passageway 60 through the central channel 48 and through the conduit 6 to the printhead 2, as illustrated in FIG. 3, in which the nozzle 68 is perfectly aligned with the central channel 48 so that ink from the first supply 28 can flow to the printhead 2. In this position, a channel extension 75, coupled to the ink conduit 6, contacts an inside wall 76 of the rectangular opening 58. By proper sizing of the rectangular opening 58, correct alignment of the central channel 48 to the passageway 60 is assured due to the contacting relationship of the channel extension 75 contacts to inside wall 76 of the rectangular opening 58. Accurate alignment may also assured by proper control of the control stem 44 positioned by the controller 46.

Whenever ink to the printhead is changed, the scanning carriage 4 is moved to the priming maintenance station 12 and the capping member 14 moves forward so that the priming element 24 makes an airtight seal with the printhead 2. Once in contact, the selecting member 46 is adjusted to align the central channel 48 with the third passage 64. Perfect alignment of the central channel 48 with the third passage 64 is not necessary since both the channel 48 and third passageway 64 feed into the chamber 66 if not perfectly aligned. Accurate alignment is necessary, however, when the central channel 48 aligns with either the first passageway 60 or the second passageway 62.

Figure 4:
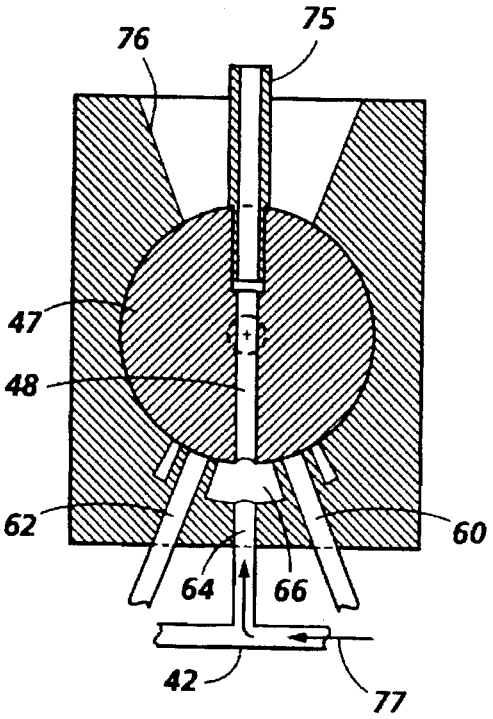

As illustrated in FIG. 4, once the central channel 48 is aligned with the third passageway 64, air from the air supply 38 is forced through the purge line 36 to force any of the ink, of the type found in the ink supply 28, from the valve 26 and through the printhead 2. It is advantageous to energize the suction pump 20 for predetermined period of time so as to remove the ink from the printhead. Air from the air supply 38 flows in the direction of the arrow 77 through the T coupler 42.

Figure 5:
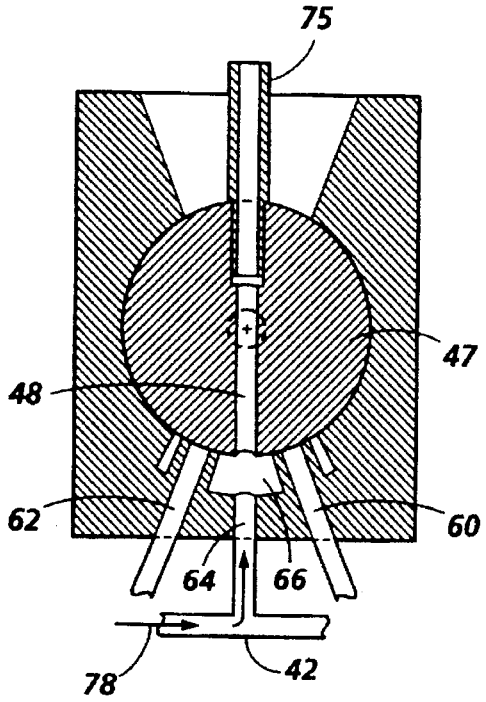

Once the air passes through the selecting valve 26 for a sufficient amount of time, water or some other cleaning material, from the supply 40, is directed through the selecting valve 26 in the direction of the arrow 78 as shown in FIG. 5. The solvent is forced through the central channel 48, through the conduit 6 and out through the printhead 2 into the trap 16 with additional assistance of the suction supply 20. When the solvent flows through the third passageway 64, it fills the chamber 66 washing away any ink which remains on the outer surface of the selecting member 46 and present in the chamber 66. By forcing air or a solvent under pressure through the chamber 66 and central channel 48, contamination between inks of different types is avoided. Both the outer surface of the sphere and the chamber 66 are cleaned of residual ink.

Once the solvent passes through the chamber 66 and the channel 48 for a sufficient amount of time to wash away residual ink, air from the air supply 38 is directed a second time through the third passageway 64, the chamber 66 and the central channel 48 as previously illustrated in FIG. 4. The application of forced air through the selection valve 26 forces the solvent previously flowing through the valve into the trap 16. As before, the suction pump 20 removes any of the solvent remaining in the printhead 2.

Figure 6:
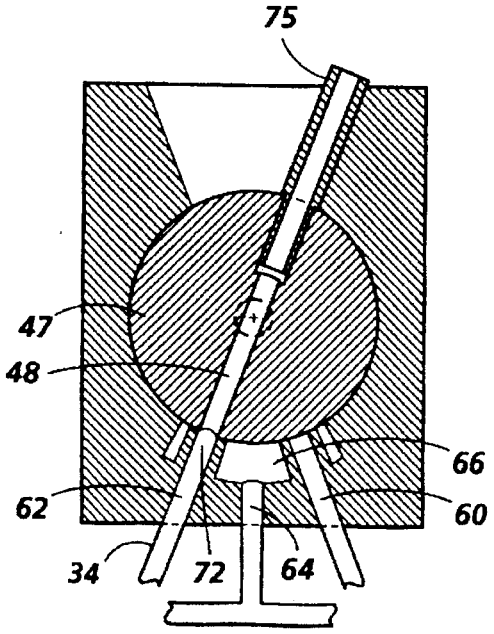

After sufficient purging of the lines with air, the selecting member 46 is adjusted to align the central channel 48 with the second passageway 62 as illustrated in FIG. 6. In this position, the nozzle 72 contacts the outer surface of the selecting member 46 and provides a seal therebetween so that ink from the ink supply 32 passes through the passageway 62, through the central channel 48, and not into the chamber 66. Consequently, the present invention includes a valve which carries either ink, water or air to the printhead of the printing device. The valve arrangement has no dead spaces that can hold ink of the first type which would subsequently contaminate ink of a second type.

As described, inks of different colors or types are selected by positioning the selecting member 46 within the housing 27 to align the central channel 48 with any of the passageways 60 and 62. It should be noted that additional passageways could be added to the valve so that the valve could accommodate any number of types of inks. It is also possible that additional passageways for carrying ink need not be on the same plane as the plane described for the passageways 60, 62 and 64.

It is therefore apparent that there has been provided in accordance with the present invention an ink supply apparatus that fully satisfies the aims and advantages hereinbefore set forth. While this invention has been described with a specific embodiment thereof it is evident that many alternatives, modifications and variations will be apparent to those skilled in the art. For instance, it is possible to devise a valve which is controlled by moving the control stem from side to side instead of being controlled by rotation of the control stem to select inks. Accordingly, it is intended to embrace all such alternatives, modifications and variations that fall within the spirit and broad scope of the appended claims.

I claim:

1. A valve for selecting an ink station or a cleaning station, comprising:

a selecting member, including a surface, defining an aperture therethrough; and a housing defining a plurality of passageways, said housing and said selecting member cooperating with one another so that relative movement therebetween aligns the aperture of said selecting member with one of said passageways of said housing, said housing including a cleaning chamber disposed adjacent said selecting member, said cleaning chamber exposing said surface of said selecting member during alignment with the aperture of said selecting member, the ink station being in communication with a first of said passageways in said housing and the cleaning station being in communication with a second of said passageways in said housing that is connected to said cleaning device.

2. The valve of claim 1, wherein a second ink station is in communication with a third passageway in said housing.

3. The valve of claim 2, wherein the first mentioned ink station comprises a first ink, and the second ink station comprises a second ink different from the first ink.

4. The valve of claim 3, wherein the cleaning station comprises a supply of solvent.

5. The valve of claim 3, wherein the cleaning station comprises an air supply.

6. The valve of claim 1, wherein said selecting member comprises a sphere, with the aperture being a channel having a first end and a second end.

7. The valve of claim 6, wherein said housing defines a cavity having said sphere rotatably mounted therein.

8. The valve of claim 7, wherein said housing defines an output opening communicating with the first end of the channel.

9. The valve of claim 8, further comprising an extension attached to the first end of the channel.

10. An ink supply apparatus, comprising:

a selecting member, including a surface, defining an aperture therethrough;

a housing defining a plurality of passageways, said housing and said selecting member cooperating with one another so that relative movement therebetween aligns the aperture of said selecting member with one of said passageways of said housing, said housing including a cleaning chamber disposed adjacent said selecting member, said cleaning chamber exposing said surface of said selecting member during alignment with the aperture of said selecting member;

a first ink supply connected to a first passageway of the plurality of passageways;

a second ink supply connected to a second passageway of the plurality of passageways;

a solvent supply connected to a third passageway of the plurality of passageways; and an air supply connected to the third passageway of the plurality of passageways, wherein said third passageway is connected to the cleaning chamber.

11. The ink supply apparatus of claim 10, further comprising a first nozzle member coupled to one of the plurality of passageways and contacting said selecting member.

12. The ink supply apparatus of claim 11, further comprising a second nozzle member coupled to another of the plurality of passageways and contacting said selecting member.

13. The ink supply apparatus of claim 12, wherein said housing and said selecting member cooperate with one another so that relative movement therebetween aligns the aperture of said selecting member with a passageway of said housing.

* * * * *